US005629658A

United States Patent [19]

Chen

[11] Patent Number: 5,629,658

[45] Date of Patent: May 13, 1997

[54] METHODS OF ARC SUPPRESSION AND CIRCUIT BREAKERS WITH ELECTRONIC ALARMERS

[76] Inventor: William W. Chen, Dept. of Mechanical and Aerospace Engineering, 151 Link Hall, Syracuse University, Syracuse, N.Y. 13244-1240

[21] Appl. No.: 332,507

[22] Filed: Oct. 31, 1994

Related U.S. Application Data

[63] Continuation-in-part of Ser. No. 931,870, Aug. 18, 1992, abandoned.

[51] Int. Cl.[6] ..... H01H 9/30

[52] U.S. Cl. ..... 335/201; 218/4

[58] Field of Search ..... 218/1, 4, 8, 15, 218/16, 18; 335/18, 6, 35, 23, 43, 201

[56] References Cited

U.S. PATENT DOCUMENTS

| | | | |
|---|---|---|---|
| 2,539,567 | 1/1951 | Best | 335/23 |
| 4,282,462 | 8/1981 | Peil et al. | 315/46 |
| 4,485,283 | 11/1984 | Hurtle | 335/195 |
| 4,819,120 | 4/1989 | O'Leary | 361/11 |
| 4,878,038 | 10/1989 | Tsai | 337/107 |
| 5,105,178 | 4/1992 | Krumme | 337/140 |
| 5,379,176 | 1/1995 | Bacon et al. | 361/106 |

*Primary Examiner*—Lincoln Donovan

[57] ABSTRACT

Methods of arc suppression connecting a PTC material in parallel with a pair of contacts but in series with a second pair of contacts. The PTC material could be doped-$BaTiO_3$-ceramics, conductive polymer, or metallic PTC materials. The two pairs of contacts should be so mechanically associated that the second pair of contacts must be always opened right after the opening of the first pair. It is enough for some applications to connect one pair of contacts in parallel with a polyswitch or $BaTiO_3$-ceramics. For medium and high voltage circuit breakers, more than two pairs of contacts may be needed, and all these contacts should be opened sequentially during a circuit interruption. According to the methods, simple structured circuit breakers can be made to protect circuits from a short circuit, an overload and a ground fault. The circuit breaker invented here can provide an electronic alarm signal when a fault current occurs. The principle of the electronic indication of a fault current is applicable to any circuit breakers. By adding a series coil around the same core of the trip coil in a common ground fault circuit interrupter or receptacle, the interrupter or receptacle can be improved to act as a circuit breaker.

19 Claims, 1 Drawing Sheet

METHODS OF ARC SUPPRESSION AND CIRCUIT BREAKERS WITH ELECTRONIC ALARMERS

BACKGROUND OF THE INVENTION

This application is a continuation-in-part application of my U.S. patent application Ser. No. 07/931,870 filed Aug. 18, 1992, which is abandoned now.

The invention relates to interruptions and protections of electric circuits, essentially to improved methods to extinguish are during a circuit interruption. It also relates to circuit breakers, ground fault circuit interrupters(GFCI), electronic indications of fault currents, PTC (positive temperature coefficient resistivity) materials. The fault currents here mean a short circuit, an overload or a ground fault current.

U.S. Pat. No. 2,639,357(1953) to Fritz Kesselring first discloses the use of a parallel PTC resistor across a pair of contacts to suppress the electric arc. U.S. Pat. No. 4,485,283(1984) to Hurtle comprises the same idea of connecting impedance means across two contacts in a circuit breaker. However, only metallic resistors are mentioned in the previous patents.

U.S. Pat. No. 4,878,038 (1989) to James Tsai discloses the use of $BaTiO_3$ ceramics and PTC polymer composites as temperature responsive electrical regulating components connected with a switch in series. The switches invented by Tsai are commonly employed in electronic circuits such as telecommunication circuits as mentioned in his patent.

One of the ideas this application discloses is to interrupt a circuit sequentially with more than one pair of contacts. It is called sequential breaking in this application. None of the above patents includes the sequential breaking idea.

U.S. Pat. No. 5,193,041(1993) to Chanois discloses a current interrupter that comprises the idea of the sequential breaking. The interrupter uses a movable contact displaceable between several fixed contacts and an open position. No metallic PTC elements are employed in this patent. The mechanism includes only one movable contact. The interruption rating of the interrupter of this patent would be much lower than that of a circuit breaker.

SUMMARY OF THE INVENTION

The main object of this invention is to provide advanced methods to suppress the electric arc during a circuit interruption with PTC elements. In a common circuit breaker, nearly 100% the interruption energy goes to arcing. In other words, most of the breaker energy is consumed through generating arc during an interruption. Therefore, the interruption ratings of the existing breakers are very limited. The methods of arc suppression in this invention will convert a large portion of interruption energy (up to 100%) into thermal energy of PTC elements during a circuit interruption. Consequently it is also the object of this invention to raise the interruption ratings of circuit breakers.

Another object of this invention is to provide multiple functions to circuit breakers. Circuit breakers designed according to this invention can protect circuits from overload, short circuits and ground faults. They can also give an electronic alarm signal when a fault current occurs.

The basic idea of the arc suppression methods is to connect a PTC element in parallel with a first pair of contacts but in series with a second pair of contacts. The first pair of contact is connected in series in a circuit to be interrupted. The two pairs of contacts should be so mechanically associated that the second pair must be always opened right after the opening of the first pair. For some circuits where a small leakage current is allowed after interruption, the second pair of contact can be eliminated with a polyswitch or $BaTiO_3$ ceramics PTC element connected in parallel with the first pair. For medium and high voltage circuit breakers, more than two pairs of contacts may be needed, and all these contacts should be opened sequentially when a short circuit occurs. In the arrangement with three pairs of contacts, two PTC elements have to be used. The first PTC element should be connected in parallel with the first pair of contact but in series with second pair, the second PTC element in parallel with the second pair but in series with the third pair. The cold resistance of the first PTC element should be lower than that of the second PTC. During a short circuit, the first pair of contact has to be opened first; the second pair opened second; the third pair completes the interruption of the circuit finally.

The circuit breaker invented here can provide an electronic alarm signal when a fault current occurs. The principle is to design a switch that must be closed only at the time when a fault current occurs, and the switch should remain closed after the main circuit is interrupted. The current through the electronic alarmer should be smaller than four milliampere. After the fault current has been cleared, the switch can be opened either manually or automatically at the time of reclosing the main circuit.

After a series coil being added around the same core of the trip coil in a common GFCI or receptacle, the interrupter or receptacle can be improved to act as a circuit breaker.

DETAILED DESCRIPTION

Figure 1:
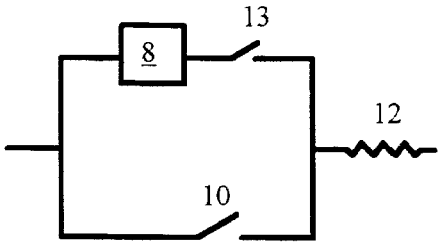
FIG. 1 is a general schematic diagram of the circuitry showing the first method of arc suppression in this invention.

The highlight of this invention is to provide methods to suppress electrical arcs efficiently during circuit interruptions. FIG. 1 is a general schematic diagram showing how the arc is suppressed in the first method. In FIG. 1, a pair of main contact 10, is connected in parallel with a PTC material 8 and another pair of contact 13. The PTC 8 could be a block of a $BaTiO_3$ ceramics or conductive polymer(polyswitch), and is connected in series with the contact 13. The main contact 10 can also be connected in series with the contact 13. This method shown in FIG. 1 is especially suitable for low voltage circuits(120V to 600V).

Under normal operation, the main contact 10 and contact 13 are closed and an electric current is flowing through the circuit. More current flows through the contact 10 than that through the PTC 8, since the resistance of the contact 10 is relatively small compared to that of the PTC 8. The PTC 8 will not trip, if the current is below the Ampere rating.

When the contact 10 is opened, the arc is suppressed since not all the current goes to arcing. The current is shunted to pass through the PTC 8. The shunted current overheats the PTC 8 in a predetermined time. The resistance of the PTC 8 increases so greatly that the current through the circuit drops dramatically after the predetermined time. The contact 13 is opened one to ten milliseconds after the opening of the main contact 10, and complete the interruption finally. By the time the contact 13 is opening, there is little current left in the circuit. This is how the circuit is interrupted during an interruption. The two pairs of contacts 10 and 13 should be so mechanically associated that a timely sequential breaking is ensured during each interruption. During a short circuit, the interruption energy is converted in part to arcing energy and in part to thermal energy of the PTC 8. It can be designed to convert a large portion of the interruption energy to the thermal energy of the PTC 8, and thus reducing the arcing energy dramatically.

In order to suppress the are more effectively during a short circuit, a metallic PTC element 12 can be connected into the circuit in series. The metallic PTC 12 should be chosen not to create temperature rising problems during normal operations, and not to be burned down during a short circuit. The resistivity of the metallic PTC material 12 at its melting point should be at least 5 times its room temperature resistivity. Examples of the metallic PTC materials are tungsten, iron, tantalum, and molybdenum.

The contact 13 can be eliminated and the contact 10 is simply connected in parallel with the PTC 8 for some circuits. The circuits can allow a leakage current smaller than 1A after being interrupted. The available short circuit current of the circuits is less than 4,000A and the voltage of the circuits is less than 600V. The voltage of the circuits should be lower than or equal to the voltage rating of the PTC 8. The resistivity of the PTC 8 at a temperature higher than 150° C. must be at least 100 times the resistivity at room temperature.

Figure 2:
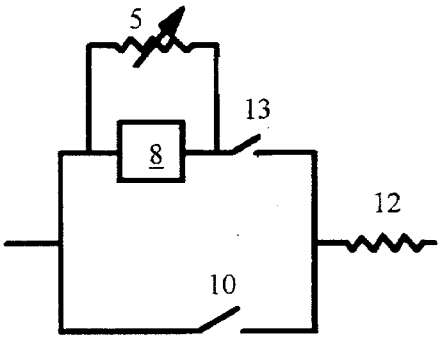
FIG. 2 is a general schematic diagram of the circuitry showing another embodiment of the first method in this invention.

FIG. 2 is another embodiment of FIG. 1. The PTC 8 is bridged by a varistor 5, which provides an overvoltage protection for the PTC 8. The varistor 5 or MOV can absorb extra energy which the PTC 8 cannot take during an interruption. The voltage rating of the varistor 5 should be lower than that of the PTC 8. The embodiment in FIG. 2 has a higher interruption capability than that in FIG. 1, provided that the size and rating of the PTC 8 remains the same. In a circuit that does not need the contact 13, the voltage rating of the varistor should be larger than the voltage of the circuit.

Figure 3:
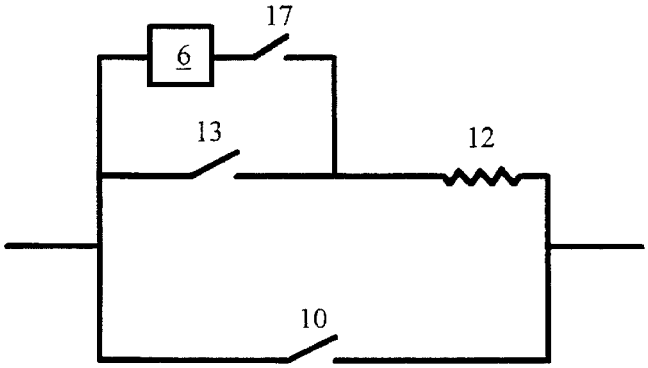
FIG. 3 is a general schematic diagram of the circuitry showing the second method of arc suppression.

FIG. 3 shows the second method of arc suppression with sequential breaking. This method is especially suitable for medium and high voltage circuits. In the figure, three pairs of contacts 10, 13 and 17 are connected in parallel. A polymer or metallic PTC 6 is connected in series with contact 17 but in parallel with contact 13. The other metallic PTC 12 is connected in series with the contact 13 but in parallel with the contact 10. The room temperature resistance of the PTC 12 should be lower than that of the PTC 6. However the power of the PTC 12 should be larger than that of the PTC 6. In other words, it takes more energy to melt the PTC 12 than the PTC 6. Of course, more pairs of contacts and more steps of PTC elements can be employed in a high voltage, or high interruption rated circuit breaker. There could be other circuit connections for different applications.

In FIG. 3, if the circuit needs to be interrupted, the contact 10 should be opened first, the contact 13 second, and the contact 17 third. The current through the metallic PTC 12 increases when contact 10 is opened. The PTC 12 will convert part of the interruption energy into thermal energy, and the electrical power in the circuit will drop to a lower level at the opening moment of the contact 13. The current through the PTC 6 increases when the contact 13 is opened. The PTC 6 and 12 together will convert a lot of interruption energy into heat, and the electrical power in the circuit will drop to the lowest level at the opening moment of the contact 17. During this process, most of the interruption energy is converted into thermal energy, only a small portion of it is released through arcing. Consequently, the arc is suppressed during the interruption. Besides, the PTC materials 12 and 6 have self current limiting effect during a short circuit interruption. They will limit the inrush current to a low level, and achieve an effective current limitation.

The time taken for circuit interruptions with sequential breaking here will be in the same order or even less than the interruption time of an existing circuit breaker or switchgear. The method of sequential breaking is especially suitable for inductive circuits, because the current decreases gradually during an interruption and thus reducing the inductive current.

Figure 4:
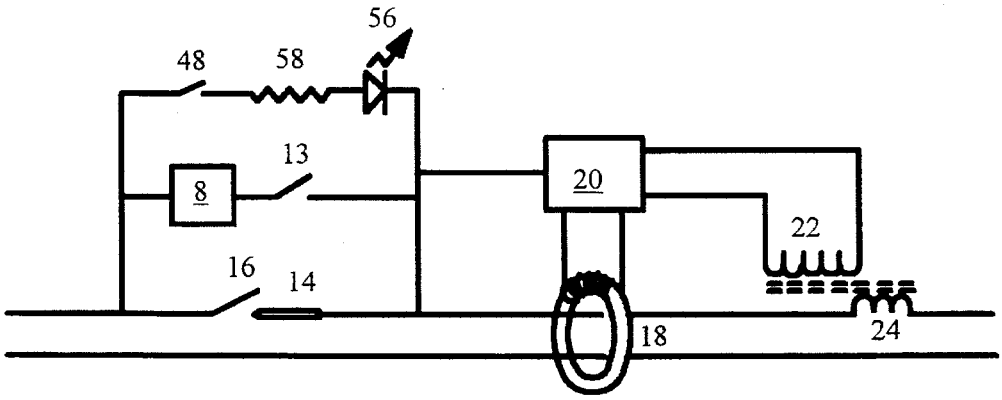
FIG. 4 is a schematic diagram of the circuit of a typical circuit breaker that not only can protect from an overload, a short circuit and a ground fault, but also can give an electronic alarm when any of them occurs.

FIG. 4 is a schematic diagram of the circuit of a typical circuit breaker that not only protects from an overload and a short circuit but also a ground fault. Additionally, this breaker will also give an electronic alarm when any of them occurs. In FIG. 4, a bimetal 14 is connected in series with a series coil 24 in the main circuit. As in an existing thermal-magnetic circuit breaker, the bimetal 14 here provides overload protection. A PTC 8 and a pair of contact 13 are connected in parallel with main contact 16 of the breaker. A light-emitting diode 56, a resistor 58 and a switch means 48 are connected in series with each other before they are connected in parallel with the main contact 16. The light-emitting diode 56 can be replaced by a sound producing element, or any other electronic means that gives an alarm signal with a small current(<4 mA) when the switch means 48 is closed. A normal fault-detector coil 18 and a GFCI circuit board 20 are also included in the circuit. The trip coil 22 and the series coil 24 are wound around the same core, and they will separate the main contact 16 during a ground fault or a short circuit respectively.

The interaction between the trip coil 22 and the series coil 24 will not affect the function of the breaker. In fact, there is no electric current including inductive current in the trip coil 22 unless a ground fault occurs, because the trip coil 22 is opened by a thyristor on the board 20. When a short circuit and a ground fault occur at the same time, a large current passes the series coil 24 and only inductive current flows in the trip coil 22. In this case and in a case with only a short circuit happening, the attractive force produced by the series coil 24 is the dominant force that will trip the breaker. When only a ground fault occurs, however, the force produced by the trip coil 22 becomes dominant, and this force will interrupt the circuit.

The switch means 48 will provide electronic indications for a short circuit or a ground fault. The switch 48 should remain open during normal operations. It must be closed when a fault current occurs and should remain closed after the main circuit is interrupted until the fault current is cleared. There is a current flowing through the electronic alarmer 56 when the switch 48 is closed. The current through the electronic alarmer should be smaller than four milliampere that it does not hurt any human being generally. After the fault current has been cleared, the switch can be opened either manually or automatically at the time of reclosing the main circuit. The key point is that the switch 48 must remain closed and the alarm signal stays on after the main circuit is interrupted until the fault current is cleared. The switch 48 must never be closed manually. This design is applicable to any circuit breakers with many variations to give an electronic alarm signal only when a fault current occurs.

The specific engineering designs to realize the methods shown in FIGS. 1 to 4 could be many and varied. Although the description above contains many specifications, these should not be construed as limiting the scope of the invention but as merely providing illustrations of some of the presently preferred embodiments of this invention.

Then the scope of this invention should be determined by the appended claims and their legal equivalents, rather than by the examples given.

I claim:

1. A method for interrupting a circuit with efficient are suppression comprising:

connecting a member of PTC elements selected from the group consisting of doped-$BaTiO_3$-based ceramics and conductive polymers in parallel with a first pair of contacts but in series with a second pair of contacts, said first pair of contacts being connected in series with said circuit, said second pair of contacts being connected in parallel with said first pair of contacts, said first pair of contacts being so mechanically associated with said second pair of contacts that said second pair of contacts is always opened one to ten millisecond after the opening of said first pair of contacts to interrupt said circuit.

2. A method for interrupting a circuit of claim 1, further including:

connecting a member of varistor in parallel with said member of PTC materials selected from the group consisting of doped-$BaTiO_3$-based ceramics and conductive polymers, the voltage rating of said varistor being smaller than that of said PTC elements.

3. A method for interrupting a circuit of claim 1, further including:

connecting a metallic PTC element in series with said circuit, the resistivity of said metallic PTC element at its melting point being at least 5 times its room temperature resistivity.

4. A method for interrupting a circuit with efficient arc suppression comprising:

connecting a first PTC element in parallel with a first pair of contacts but in series with a second pair of contacts, and a second PTC element in parallel with said second pair of contacts but in series with a third pair of contacts, said first pair of contacts being connected in series with said circuit but in parallel with said second pair of contacts and in parallel with said third pair of contacts, said first pair of contacts being opened first, said second pair of contacts being opened second, and said third pair of contacts being opened finally to interrupt current flow through said circuit.

5. A method for interrupting a circuit of claim 4, further including:

said first and second PTC elements being made from metallic PTC materials, the resistivities of said metallic PTC materials at their melting points being at least 5 times their room temperature resistivities.

6. A method for interrupting a circuit of claim 5, further including:

said metallic PTC materials being tungsten.

7. A method for interrupting a circuit of claim 4, further including:

the room temperature resistance of said first PTC dement being less than that of said second PTC element.

8. A method for interrupting a circuit of claim 4, further including:

the power of said first PTC element being larger than that of said second PTC element.

9. A circuit breaker produced in accordance with the method of claim 4 comprising:

a case, said first pair of contacts connected in series with said circuit, said first PTC element connected in parallel with said first pair of contacts, said second pair of contacts connected in parallel with said first pair of contacts but in series said first PTC element, said second PTC element connected in parallel with said second pair of contacts, said third pair of contacts connected in parallel with said second pair of contacts but in series with said second PTC element, and means to sequentially separate said first pair of contacts first, said second pair of contacts second, and said third pair of contacts finally during an interruption.

10. A circuit breaker with PTC element and sequential breaking comprising:

a case, a first pair of contacts connected in series with a circuit, a metallic PTC element connected in parallel with said first pair of contacts, the resistivity of said metallic PTC element at its melting point being at least 5 times its room temperature resistivity, a second pair of contacts connected in series with said metallic PTC element and in parallel with said first pair of contacts, means to separate said first pair of contacts when a short circuit or an overload occurs in said circuit, and means to separate said second pair of contacts one to ten millisecond after the opening of said first pair of contacts during a circuit interruption.

11. A circuit breaker of claim 10 further comprising:

said metallic PTC element being made from tungsten.

12. A circuit breaker of claim 10 further comprising:

another metallic PTC element connected in series with said circuit, the resistivity of said another metallic PTC element at its melting point being at least 5 times its room temperature resistivity.

13. A method for interrupting a circuit with efficient arc suppression comprising:

connecting a member of PTC elements selected from the group consisting of doped-$BaTiO_3$-based ceramics and conductive polymers in parallel with a pair of electrical contacts, said pair of electrical contacts being connected in series with said circuit, a leakage current less than 1A being allowed in said circuit after said pair of electrical contacts being opened, the available short circuit current of said circuit being less than 4,000A and the voltage of said circuit being less than 600V, said voltage of said circuit being not higher than the voltage rating of said PTC elements, said PTC elements being characterized in that their resistivities at a temperature higher than 150° C. must be at least 100 times their resistivities at room temperature.

14. A method for interrupting a circuit of claim 13, further including:

connecting a member of varistor in parallel with said member of PTC elements selected from the group consisting of doped-$BaTiO_3$-based ceramics and conductive polymers, the voltage rating of said varistor being higher than said voltage of said circuit.

15. A method for interrupting a circuit of claim 13, further including:

said member of PTC elements being a polyswitch made from conductive polymers.

16. A circuit breaker for protection from not only a short circuit and an overload, but also a ground fault comprising:

a case, a pair of electrical contacts, a ground fault-detector coil, a trip coil and a series coil around the same core, a thyristor mounted on a circuit board and connected to said fault-detector coil and said trip coil, means to separate said contacts with the attraction of said trip coil or said series coil when a ground fault or a short circuit occurs respectively, and means to separate said contacts when an overload occurs.

17. A circuit breaker of claim 16 further comprising:

a member of PTC materials selected from the group consisting of doped-$BaTiO_3$-based ceramics or conductive polymers connected in parallel with said pair of contacts, and another pair of contacts connected in series with said member of PTC materials, said another pair of contacts being so mechanically associated with said pair of contacts that said another pair of contacts are opened fight after the opening of said pair of contacts during a circuit interruption.

18. A circuit breaker with an electronic indicator of a fault current comprising:

a case, a pair of main contacts, means to separate said main contacts when said fault current occurs, a pair of small contacts, means to give a force when said fault current occurs, means to close said pair of small contacts only by said force and to keep said pair of small contacts closed even after said pair of main contacts being automatically opened because of said fault current, means to give an electronic signal by a small current when said pair of small contacts are closed, and means to open said pair of small contacts when said main contacts are reclosed.

19. A circuit breaker of claim 18 wherein said means to give an electronic alarm signal when said pair of small contacts are closed comprising a light-emitting diode connected in series with a resistor and said pair of small contacts.

* * * * *

UNITED STATES PATENT AND TRADEMARK OFFICE

CERTIFICATE OF CORRECTION

Patent Number: *5,629,658*
Dated: *May 13, 1997*
Inventor: *William Weizhong Chen*

It is certified that error appears in the above-identified patent and that said Letters Patent is hereby corrected as shown below:

Column 1, line 11, delete 'are' and insert --arc-- therefor;

Column 3, line 16, delete 'are' and insert --arc-- therefor;

Column 5, line 11, delete 'are' and insert --arc-- therefor; and

Column 8, line 1, delete 'fight' and insert --right--.

Signed and Sealed this

Fifth Day of August, 1997

Bruce Lehman

*Attest:*

BRUCE LEHMAN

*Attesting Officer*

*Commissioner of Patents and Trademarks*